US005390854A

United States Patent [19]

Hench

[11] Patent Number: 5,390,854

[45] Date of Patent: Feb. 21, 1995

[54] COOLANT SPRAY SYSTEM

[76] Inventor: Lee E. Hench, 24141 Hurst, Lake Forest, Calif. 92630

[21] Appl. No.: 110,633

[22] Filed: Aug. 23, 1993

Related U.S. Application Data

[63] Continuation-in-part of Ser. No. 955,321, Oct. 1, 1992, abandoned.

[51] Int. Cl.[6] ..... B05B 7/32

[52] U.S. Cl. ..... 239/337; 239/346; 239/366; 239/407; 239/413

[58] Field of Search ..... 239/337, 340, 346, 364–366, 239/368, 369, 433, 434, 407, 413, 417.5

[56] References Cited

U.S. PATENT DOCUMENTS

| | | | |
|---|---|---|---|
| 591,576 | 10/1897 | Thompson et al. | 239/368 |
| 988,693 | 4/1911 | Chalmers | 239/368 |
| 1,860,136 | 5/1932 | Bunch | 239/366 |
| 2,599,678 | 6/1952 | Walker | 239/366 |
| 2,868,584 | 1/1959 | Faust | 239/366 |
| 3,104,826 | 9/1963 | Morris | 239/413 |
| 3,106,346 | 10/1963 | Thomas | 239/366 |
| 3,253,788 | 5/1966 | McHugh et al. | 239/434 |
| 3,394,888 | 7/1968 | Dasse et al. | 239/417.5 |
| 3,455,513 | 7/1969 | Wyse | 239/366 |
| 3,759,449 | 9/1973 | Ruthman et al. | 239/413 |
| 4,006,861 | 2/1977 | Alger et al. | 239/311 |
| 5,054,687 | 10/1991 | Burns et al. | 239/373 |

*Primary Examiner*—Karen B. Merritt

[57] ABSTRACT

An apparatus is provided for delivering a combination of gas and liquid. A container provides a liquid admitting cap, a gas admitting port, and a liquid discharging port. A combining assembly has a first chamber in fluid communication with the liquid discharging port, and a second chamber is in fluid communication with the gas admitting port. Both chambers are interconnected through a combining valve. Flexible tubes are included for interconnecting the gas admitting port with the second chamber, and for interconnecting the liquid discharging port with the first chamber, so that the combining assembly may be positioned remotely from the container. A gas pressure controller is interconnected with the gas admitting port for selecting a pressure level of the gas. In operation, the liquid is forced out of the container and into the first chamber by the gas. The relative volume of the liquid flowing into the first chamber to the volume of the gas flowing into the second chamber is determined by the combining valve. The liquid flows from the first chamber to be combined with the gas in the second chamber, thereby forming a two-phase flow of liquid and gas. The combination leaves the second chamber through an outlet nozzle as a stream of liquid entrained within a stream of gas. The ratio of liquid to gas in the combination is determined by the combining valve, and the total pressure of the combination is determined by the gas pressure controller, the initial pressure of the gas, and the diameter of the nozzle.

9 Claims, 1 Drawing Sheet

COOLANT SPRAY SYSTEM

CROSS-REFERENCE TO RELATED APPLICATIONS

This is a continuation-in-part of application Ser. No. 07/955,321, filed Oct. 1, 1992, now abandoned.

FIELD OF THE INVENTION

This invention relates generally to liquid spraying devices, and, more particularly, is directed towards a spray system for delivering a liquid and gas together as a two-phase flow.

BACKGROUND OF THE INVENTION

When machining parts it is often necessary to provide a lubricating spray for cooling both the part being machined and the tool cutting the part. Such a lubricating spray, to be effective, must be directed to the immediate interface between the tool and the part. Several prior art devices exist to accomplish such spraying.

For example, one such device is taught in U.S. Pat. No. 4,006,861 to Alger et al. on Feb. 8, 1977. Such a device uses a source of compressed air to force a liquid lubricant, such as machine oil, from a container through a tube and nozzle and finally onto the part being machined. However, such a device comprises a relatively large number of components, making such a device relatively expensive. Further, such a device utilizes a co-axial double cable, wherein the lubricant and the gas travel separately until reaching the tip of the nozzle. A venturi nozzle tip atomizes the lubricant into a fine mist that is directed toward the workpiece. Prior art devices commonly atomize the lubricant into such a mist, much of which becomes suspended in the air around the tool and throughout the room or building. Not only does such a device effectively waste much of the lubricant, in that much of the lubricant never reaches the intended tool or workpiece, but such a suspended lubricating mist is unpleasant and unhealthy to breath. Exposing workers to an environment that contains such a suspended mist can cause worker health and morale problems. Further, such a suspended mist is detrimental to the surrounding environment in general, in that much of the air within a machine shop eventually reaches the surrounding community.

Clearly, then, there is a need for a spraying system that delivers a coherent stream of lubricating liquid to a workpiece without atomizing the liquid. Such a needed device would allow full adjustment of liquid volume and carrier gas pressure, yet would deliver the coherent stream of liquid accurately within a wide range of pressure settings. Such a needed device would be relatively inexpensive to manufacture, and would result in less liquid waste. Such a needed device could be mounted in position with a wide variety of conventional mounting means, and would be easy to set-up and use. The present invention fulfills these needs and provides further related advantages.

SUMMARY OF THE INVENTION

The present invention is a spray system for delivering a combination of gas and liquid. A container provides a liquid admitting means, a gas admitting means, and a liquid discharging means. A combining assembly has a first chamber in fluid communication with the liquid discharging means, and a second chamber is in fluid communication with the gas admitting means. Each chamber is mutually interconnected through a combining means. A tubular means is included for interconnecting the gas admitting means with the second chamber, and for interconnecting the liquid discharging means with the first chamber, so that the combining assembly may be positioned remotely from the container. A gas pressure controller is interconnected with the gas admitting means for selecting a pressure level of the gas.

In operation, the liquid is forced out of the container by the gas. The relative volume of the liquid flowing into the first chamber to the volume of the gas flowing into the second chamber is determined by the combining means. The liquid flows from the first chamber to be combined with the gas from the second chamber at the combining means, thereby forming a two-phase flow of liquid and gas. The combination leaves the second chamber through an outlet means, such as a nozzle, as a stream of liquid entrained within a stream of gas. The ratio of liquid to gas in the combination is determined by the combining means, and the total pressure of the combination is determined by the gas pressure controller, the initial pressure of the gas, and the nozzle diameter. The combining means may be set such that there is no pressure difference between the gas in the second chamber and the liquid in the first chamber. As such, the liquid will not tend to be atomized into a mist, but instead will remain a relatively coherent stream within the gas.

The present invention is a spraying system that delivers a coherent stream of lubricating liquid to a workpiece without atomizing the liquid. The present device allows full adjustment of liquid volume and carrier gas pressure, yet delivers the coherent stream of liquid accurately within a wide range of pressure settings. The present invention is relatively inexpensive to manufacture. Further, the present invention results in less liquid waste during use, making it less expensive to operate. The device may be mounted in position with a wide variety of conventional mounting means, and is easy to set-up and use. Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
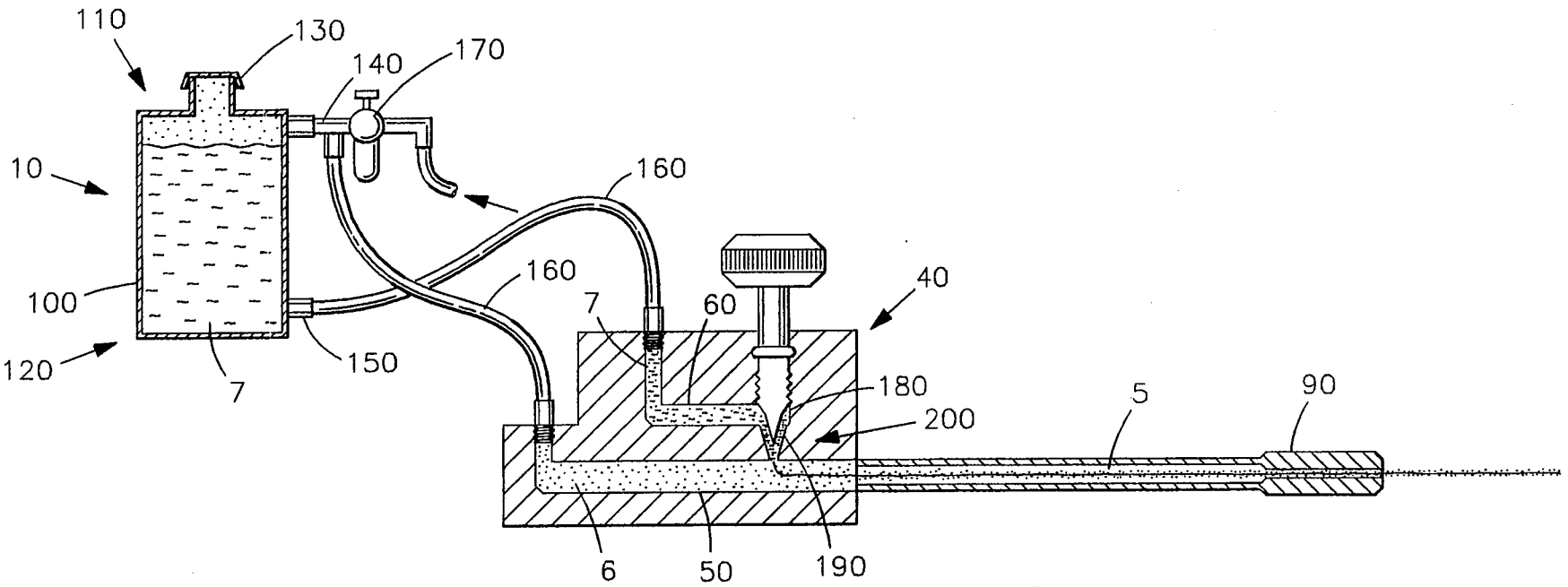
FIG. 1 is a cross sectional view of the invention, illustrating a container and a combining assembly of the invention.

FIG. 1 shows a spray system for delivering a combination 5 of gas 6 and liquid 7. A container 10 provides a liquid admitting means 130, a gas admitting means 140, and a liquid discharging means 150. A combining assembly 40 has a first chamber 60 in fluid communication with the liquid discharging means 150, and a second chamber 50 is in fluid communication with the gas admitting means 140. Each chamber 50,60 is interconnected through a combining means 200. The combining means 200 is preferably a manually adjustable valve that includes a position adjustable conical headed valve stem 180 that may be held in a conical orifice 190.

The container 10 includes a top surface 110, a side wall 100, and a bottom surface 120. Preferably, the liquid admitting means 130 is in the top surface 110, the gas admitting means 140 is adjacent to the top surface 110, and the discharging means 150 is adjacent to the bottom surface 120. A tubular means 160 is included for interconnecting the gas admitting means 140 with the second chamber 50, and for interconnecting the liquid discharging means 150 with the first chamber 60, so that the combining assembly 40 may be positioned remotely from the container 10. A gas pressure controller 170 is interconnected with the gas admitting means 140 and the second chamber 50 for selecting a pressure level of the gas 6 within the container 10 and the second chamber 50.

The combining assembly 40 and the container 10 are preferably manufactured from a rigid metallic material, or molded of a strong plastic material. The tubular means 160 are preferably manufactured from conventional plastic tubing. Clearly, all such materials must be chemically inactive with the gas 6 and the liquid 7.

The combining assembly 40 may be mounted by one of any number of conventional means near the tool. Moreover, several combining assemblies 40 may be connected to a single container 10, such as in a machine shop that has several tools. It has been found that the present invention can effectively maintain a coherent stream of liquid 7 with gas 6 at pressures of 15 to 50 psi over atmospheric. With pressures over 10 psi, the gas 6 may be further used to blow debris away from the workpiece while still delivering the coherent stream of liquid 7. Clearly, other embodiments may be devised by those skilled in the art for other specific applications without changing the spirit and scope of the present invention.

In operation, the liquid 7 is forced out of the container 10 by the gas 6. The relative volume of the liquid 7 flowing into the first chamber 60 to the volume of the gas 6 flowing into the second chamber 50 is determined by the combining means 200. The liquid 7 flows from the first chamber 60 to be combined with the gas 6 in the second chamber 50 at the combining means 200, thereby forming the two-phase flow combination 5 of liquid 7 and gas 6. The combination 5 leaves the second chamber 50 through an outlet means 90, such as a nozzle, as a stream of liquid 7 entrained within a stream of gas 6. The ratio of liquid 7 to gas 6 in the combination 5 is determined by the combining means 200, and the total pressure of the combination 5 is determined by the gas pressure controller 170, the initial pressure of the gas 6, and the diameter of the nozzle 90. In the preferred embodiment of the invention, the nozzle is between 5 and 6 inches long, and is reduced from a 0.093 inch diameter cross section to a 0.047 inch diameter cross section at about the end-most 0.75 inches thereof. The combining means 200 may be set such that there is no pressure difference between the gas 6 in the second chamber 50 and the liquid 7 in the first chamber 60. As such, the liquid 7 will tend not to be atomized into a mist, but instead will remain a relatively coherent, solid, semi-continuous stream within the gas 6. With such a setting of the combining means 200, the coherent stream has been found to travel along to one side of the nozzle 90 until reaching the end thereof, thereafter remaining a coherent stream that is guided through the air by the faster moving, lower pressure stream of gas 6.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. A low pressure sprayer system for delivering a combination of gas and liquid without finely atomizing the liquid comprising:

a combining assembly having a first chamber and a second chamber, a combining means connecting the first and second chambers, a valve means in said combining means for controlling a flow of liquid which enters the second chamber from said first chamber a nozzle means connected to said second chamber downstream from where said combining means connects said first chamber to said second chamber, said nozzle means allowing the flow of liquid and gas therethrough, a container containing a supply of liquid, a tubular means for connecting said container to said first chamber, a gas admitting means, a second tubular means connecting said gas admitting means to said second chamber, the gas admitting means further being connected to said container to pressurize the liquid therein, a gas pressure controller in communication with said gas admitting means for maintaining the pressure of the gas flowing to said container and aid second chamber in the range of 15 to 50 p.s.i., whereby when gas and liquid are supplied to said combining assembly, said valve means controls said flow of liquid into said second chamber such that the pressure of the liquid in said first chamber is the same as the pressure of the gas in said second chamber so that when the liquid and gas combine in said second chamber the liquid passes through said second chamber and said nozzle means as a substantially coherent stream drawn by the surrounding gas stream.

2. The low pressure sprayer system of claim 1 wherein the container has a top surface, a side wall and a bottom surface, a liquid admitting means in the top surface, the gas admitting means being adjacent to the top surface, and one end of the tubular means connecting said container to said first chamber being adjacent to the bottom surface.

3. The low pressure sprayer system of claim 1 wherein the valve means includes a position adjustable, conical headed valve steam held in a conical orifice.

4. The low pressure sprayer system of claim 1 wherein the nozzle means includes means for allowing the combination of liquid and gas to reach an equilibrium state having the liquid stream driven by the gas stream as two separate streams combined in a common flow, whereby the liquid steam is further caused by the gas stream to move from the nozzle means to a workpiece as a solid semi-continuous flow.

5. A pressure sprayer system for delivering a combination of a gas and a liquid without finely atomozing the liquid comprising:

a combining assembly having a first chamber and a second chamber, a combining means connected the first and the second chambers, a valve means in said combining means for controlling a flow of liquid entering the second chamber from the first chamber, said second chamber terminating in a nozzle means for dispensing the flow of the liquid and gas in combination as a free, directed coherent stream;

a container for holding a quantity of the liquid, the container being interconnected with the fist chamber for delivering a continuous flow of the liquid thereto;

a gas admitting means interconnected with the second chamber and also with the container, for pressurizing the container to enable the liquid to flow from the container to the first chamber, and for providing a continuous flow of the gas to the second chamber the liquid pressure being great enough to ensure entry into the gas stream, such that the liquid and the gas combine and, together flow through the nozzle means as two separate streams combined in a common flow.

6. The pressure sprayer of claim 5 wherein the gas is controlled to a pressure value above 10 psi, such that the gas stream leaving the nozzle means provides a means for blowing debris from a workpiece.

7. The pressure sprayer of claim 5 wherein the gas is controlled to a pressure value below 30 psi, such that atomization of the liquid is minimized.

8. A pressure sprayer combining assembly for delivering a combination of gas and liquid without finely atomizing the liquid comprising:

a combining assembly having a first chamber and a second chamber, a combining means connecting the first and second chambers, a valve means in said combining means for controlling a flow of liquid which enters the second chamber from said first chamber, said first chamber connected to a liquid supply source, said second chamber connected to a gas supply source, said second chamber connected to a nozzle means for directing the flow of liquid and gas therethrough, whereby when gas and liquid are supplied to said combining assembly, said valve means controls said flow of liquid into said second chamber such that when the liquid and gas combine in said second chamber the liquid passes through said second chamber and said nozzle means as a substantially coherent stream drawn by the surrounding gas flow.

9. The pressure sprayer combining assembly of claim 8 wherein the nozzle means is long enough to allow the combination of liquid and gas to reach an equilibrium state having the liquid stream driven by the gas stream as two separate streams combined in a common flow, whereby the liquid stream is further caused by the gas stream to move from the nozzle means to a workpiece as a solid semi-continuous flow.

* * * * *